US008870556B2

(12) United States Patent
Fujiki et al.

(10) Patent No.: US 8,870,556 B2
(45) Date of Patent: Oct. 28, 2014

(54) OIL PUMP

(75) Inventors: Kenichi Fujiki, Gunma-ken (JP); Masato Izutsu, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 158 days.

(21) Appl. No.: 13/531,328

(22) Filed: Jun. 22, 2012

(65) Prior Publication Data

US 2012/0328464 A1 Dec. 27, 2012

(30) Foreign Application Priority Data

Jun. 27, 2011 (JP) ..... 2011-142075

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 2/10*** | (2006.01) |
| ***F04C 15/00*** | (2006.01) |
| ***F04C 2/08*** | (2006.01) |

(52) U.S. Cl.

CPC ..... *F04C 2/102* (2013.01); *F04C 15/0049* (2013.01); *F04C 2210/206* (2013.01); *F04C 2/084* (2013.01)

USPC ..... 418/171; 418/150

(58) Field of Classification Search

CPC ..... F04C 15/0049; F04C 2/084; F04C 2/102; F04C 2210/206

USPC ..... 418/166, 171, 150

See application file for complete search history.

(56) References Cited

U.S. PATENT DOCUMENTS

| | | | | |
|---|---|---|---|---|
| 2,792,788 | A * | 5/1957 | Eames, Jr. | 418/171 |
| 2,960,884 | A | 11/1960 | Hill, II | |
| 8,096,795 | B2 | 1/2012 | Ono et al. | |
| 2004/0057860 | A1* | 3/2004 | Amano et al. | 418/171 |
| 2005/0047939 | A1* | 3/2005 | Fujiki et al. | 417/410.4 |
| 2009/0116989 | A1* | 5/2009 | Ono et al. | 418/150 |
| 2010/0129253 | A1* | 5/2010 | Nunami et al. | 418/150 |
| 2012/0128520 | A1 | 5/2012 | Ono et al. | |

FOREIGN PATENT DOCUMENTS

| | | | | |
|---|---|---|---|---|
| JP | 61-8484 (A) | | 1/1986 | |
| JP | 2004-36588 (A) | | 2/2004 | |
| JP | 2004036588 A | * | 2/2004 | F04C 2/10 |
| JP | 2007-085256 A | | 4/2007 | |
| JP | 2007-262963 (A) | | 10/2007 | |
| WO | WO 2007/034888 A1 | | 3/2007 | |

OTHER PUBLICATIONS

European Search Report dated Oct. 31, 2013.

* cited by examiner

*Primary Examiner* — Theresa Trieu

(74) *Attorney, Agent, or Firm* — McGinn IP Law Group, PLLC

(57) ABSTRACT

An oil pump is increased to inhibit noise generation and durability is also improved. The oil pump includes a pump body, an inner rotor having outer teeth, and an outer rotor having inner teeth. A maximum partition portion is formed between a trailing end side of an intake port and a leading end side of a discharge port in a rotor chamber of the pump body. Among cells constituted by the outer teeth of the inner rotor and the inner teeth of the outer rotor, a central cell positioned in the location of the maximum partition portion and adjacent cells positioned before and after the central cell in the direction of rotation are sealed by mutual contact of the outer teeth and the inner teeth. The outer teeth and the inner teeth constituting cells other than the central cell and adjacent cells are not in contact with each other.

9 Claims, 2 Drawing Sheets

ENLARGED (α) PORTION

OIL PUMP

BACKGROUND OF THE INVENTION

1. Field of the Invention

The present invention relates to an oil pump in which the number of teeth is increased to inhibit noise generation and durability is also improved.

2. Description of the Related Art

A problem associated with a rotor with a small number of teeth is that the discharge amount per one cell increases, thereby increasing pulsations, causing vibrations of the oil pump body and the like, and generating noise. A method of increasing the number of teeth is often used to reduce pulsations and inhibit noise. Japanese Patent Application Publication No. 2007-85256 describes the configuration in which the number of teeth is increased by comparison with that of the teeth with a typical toroidal profile.

In the configuration described in Japanese Patent Application Publication No. 2007-85256, the number of teeth is increased by reducing the so-called tooth size, which is a size from the tooth tip to the tooth bottom. Thus, the tooth profile described in Japanese Patent Application Publication No. 2007-85256 is squeezed radially with respect to the typical toroidal tooth profile. Because of such a profile, the region close to the dot-dash line (base circle A) shown in FIG. 1 of Japanese Patent Application Publication No. 2007-85256, that is, the intermediate region between the tooth tip and tooth bottom, protrudes circumferentially outward relative to other regions.

Since the inner rotor 10 and the outer rotor 20 should rotate without minimum limit cutting into each other, the respective outer teeth and inner teeth thereof have profiles that are hollowed out more than the usual tooth profiles. The outer teeth 11 of the inner rotor 10 disposed in the left-right direction in FIG. 1 of Japanese Patent Application Publication No. 2007-85256 and the inner teeth 21 (two teeth on the right side and one on the left side) of the outer rotor 20 are in contact, but other teeth, that is, the teeth disposed in two locations on the upper side and two locations on the lower side in FIG. 1, are not in contact and large gaps are opened therebetween.

The problem associated with the oil pump rotor of Japanese Patent Application Publication No. 2007-85256 having such a configuration is that since the number of outer teeth 11 of the inner rotor 10 and the number of inner teeth 21 the outer rotor 20 that are in contact with each other is small (three), larger stresses (forces) are generated in the contact portions and the durability of the rotor decreases.

In an oil pump with a tooth profile having a toroidal shape that has been widely used, the outer teeth of the inner rotor and the inner teeth of the outer rotor are all in contact with each other.

In other words, the problem associated with the decrease in rotor durability is not encountered when the tooth profile has a toroidal shape. Such a problem arises because not all of the teeth are in contact when a tooth profile of a non-toroidal shape is used as a measure to increase the discharge amount or efficiency.

SUMMARY OF THE INVENTION

It is an object of (a technical problem to be resolved by) the present invention to increase the number of teeth that are in contact, while using a non-toroidal shape, thereby decreasing stresses applied to the teeth and increasing the durability of the rotor.

The inventors have conducted a comprehensive study aimed at the resolution of the above-described problem and found that the above-described problem can be resolved by the first aspect of the present invention residing in an oil pump including a pump body, an inner rotor having outer teeth, and an outer rotor having inner teeth, wherein a maximum partition portion is formed between a trailing end side of an intake port and a leading end side of a discharge port in a rotor chamber of the pump body; among cells constituted by the outer teeth of the inner rotor and the inner teeth of the outer rotor, a central cell positioned in the location of a maximum partition portion and adjacent cells positioned before and after the central cell in a direction of rotation are sealed by mutual contact of the outer teeth and the inner teeth; and the outer teeth and the inner teeth constituting cells other than the central cell and adjacent cells are not in contact with each other.

The second aspect of the present invention resolves the above-mentioned problem by providing the oil pump according to the first aspect, wherein a tooth tip of the outer tooth of the inner rotor is a contact region that is in contact with the inner tooth of the outer rotor, and a side surface between the tooth tip and tooth bottom of the outer tooth is a non-contact region that is not in contact with the inner tooth. The third aspect of the present invention resolves the above-mentioned problem by providing the oil pump according to the first aspect, wherein a tooth tip of the inner tooth of the outer rotor is a contact region of contact with the outer tooth of the inner rotor, and a side surface between the tooth tip and tooth bottom of the inner tooth is a non-contact region that is not in contact with the outer tooth.

In the configuration according to the first aspect of the present invention, the number of outer teeth of the inner rotor and the inner teeth of the outer rotor that are in contact with each other during the operation can be increased by comparison with that in the conventional configuration described in Japanese Patent Application Publication No. 2007-85256 and the stress or impact force per one contacting tooth can be reduced. As a result, the durability of the inner rotor and outer rotor can be increased.

In the configuration according to the second aspect of the present invention, since the tooth tip of the outer tooth of the inner rotor is a contact region of contact with the inner tooth of the outer rotor and a side surface between the tooth tip and tooth bottom of the outer tooth is a non-contact region that is not in contact with the inner tooth, the inner rotor and outer rotor can have the simplest shape. Further, the inner rotor shape can be molded using the mold shape. Therefore, no special machining is required, the increase in cost can thus be prevented, and the oil pump of a low cost can be provided. The third aspect of the present invention demonstrates the effect similar to that of the second aspect.

DESCRIPTION OF THE PREFERRED EMBODIMENTS

Figure 1A:
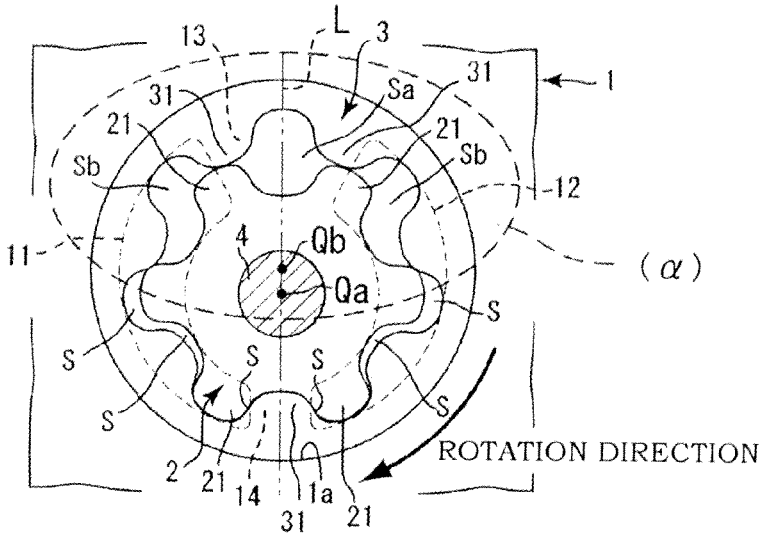
FIG. 1A is a front view illustrating the configuration in accordance with the present invention.

An embodiment of the present invention will be explained below with reference to the appended drawings. The main constituent parts in accordance with the present invention include, as shown in FIG. 1A, a pump body 1, an inner rotor 2, and an outer rotor 3. An oil pump for a vehicle that has been widely used will be assumed as the aforementioned oil pump. The oil pump for a vehicle has the pump body 1 assembled with a cover (not shown in the figure), and a rotor chamber 1*a* is formed in either of the pump body 1 and the cover. Further, a bearing hole 1*b* for a drive shaft that rotationally drives the inner rotor 2 is formed in the rotor chamber 1*a*, and the drive shaft 4 is inserted into the bearing hole (see FIGS. 1A and 1C).

Figure 1B:
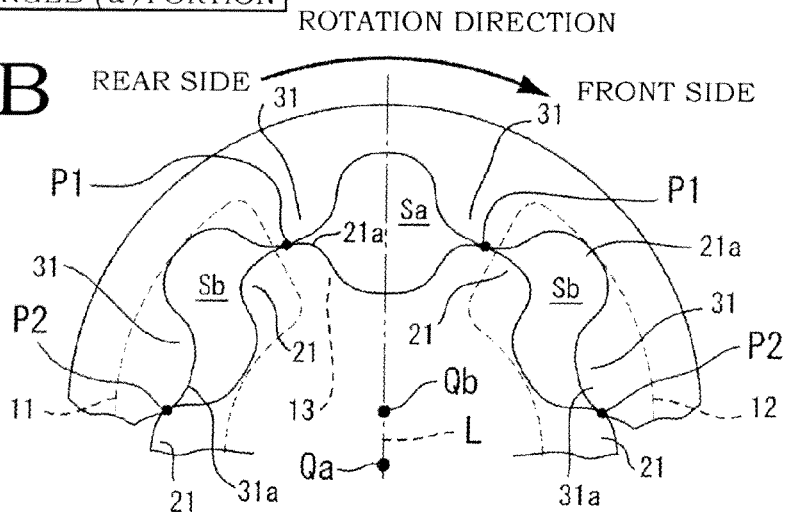
FIG. 1B is an enlarged view of the (α) portion in FIG. 1A.
Figure 1C:
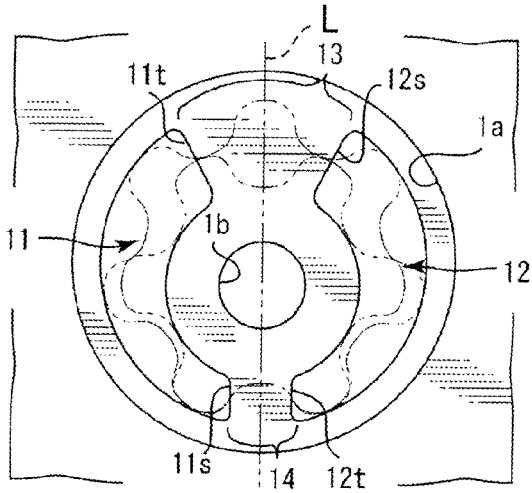
FIG. 1C is a front view illustrating the pump body.

In the embodiment of the present invention, the case is explained in which the rotor chamber 1*a* is formed at the pump body 1 side (see FIG. 1C). An intake port 11 and a discharge port 12 are formed in the rotor chamber 1*a* of the pump body 1. A maximum partition portion 13, which is a flat surface is formed between a trailing end side 11*t* of the intake port 11 and a leading end side 12*s* of the discharge port 12, and a minimum partition portion 14 is formed between a trailing end side 12*t* of the discharge port 12 and a leading end side 11*s* of the intake port 11 (see FIG. 1C).

The inner rotor 2 of a substantially gear shape having plurality of outer teeth 21 and the outer rotor 3 of a substantially annular shape having a plurality of inner teeth 31 are disposed in the rotor chamber 1*a* (see FIG. 1A). More specifically, the inner rotor 2 is disposed inside the outer rotor 3 and the rotation centers thereof are set apart. Spaces between the teeth that are called cells S are formed by the plurality of outer teeth 21 of the inner rotor 2 and a plurality of inner teeth 31 of the outer rotor (see FIG. 1A).

The outer tooth 21 of the inner rotor 2 has a non-toroidal profile that is formed as a curve of a second order or a higher order, or a combination of such curves. The profile of the inner tooth 31 of the outer rotor 3 is formed by an envelope curve which is an outermost trajectory shape attained when the inner rotor 2 rotates, as in the outer rotor of other usual oil pumps for vehicles.

In the embodiment of the present invention, the number of outer teeth 21 of the inner rotor 2 is six, and the number of inner teeth 31 of the outer rotor 3 is seven. It goes without saying that the combination of the number of outer teeth 21 of the inner rotor 2 and the number of inner teeth 31 of the outer rotor 3 is not limited to that mentioned above. The inner rotor 2 and the outer rotor 3 rotate in the same direction. For any set outer tooth 21 or inner tooth 31, the portion leading in the rotation direction of the inner rotor and the outer rotor 3 is called the front side and the portion on the other side is called the rear side.

The inner rotor 2 and the outer rotor 3 are disposed with respect to the pump body 1 of the oil pump of the above-described configuration in a manner such that two outer teeth 21 positioned on the upper side are left-right symmetrical, as shown in FIG. 1A, with respect to a vertical line L passing through the rotation center Qa of the inner rotor 2 (see FIG. 1A). The direction in which such left-right symmetry is attained is along the rotation direction of the inner rotor 2 (see FIG. 1B).

In such a state, the two upper inner teeth 31 are also left-right symmetrical with respect to the vertical line L passing through a rotation enter Qb of the outer rotor 3 (see FIGS. 1A and 1B). The direction in which such left-right symmetry is attained is also along the rotation direction of the inner rotor 2. The rotation direction of the outer rotor 3 is same as the rotation direction of the inner rotor 2. The rotation center Qa of the inner rotor 2 and the rotation center Qb of the outer rotor 3 are positioned on the same vertical line L, and the rotation center Qa and the rotation center Qb are offset in the vertical direction (see FIG. 1A).

The outer teeth 21 and the inner teeth 31 that are left-right symmetrical with respect to the vertical line L passing through the rotation centers Qa, Qb are in contact with each other, and sealed cells S are configured above the maximum partition portion 13. A plurality of cells S is formed. Among them, the cell S moving above the maximum partition portion 13 is called a central cell Sa (see FIGS. 1A and 1B). Tooth tips 21*a* of the outer teeth 21 constituting the central cell Sa and tooth tips 31*a* of the inner teeth 31 of the outer rotor 3 corresponding thereto are in contact with each other.

The contact locations are referred to as contact points P1. Two contact points P1 are positioned left-right symmetrically with respect to the vertical line L passing through the rotation enter Qa (see FIG. 1B). In this case, in the minimum partition portion 14, two outer teeth 21 are disposed left-right symmetrically with respect to the vertical line L passing through the rotation center Qa, and one inner tooth 31 meshes so as to penetrate between the two aforementioned outer teeth 21 (see FIG. 1A).

Adjacent cells Sb are present at respective positions in front of the central cell Sa and behind thereof in the rotation direction, (see FIGS. 1A and 1B). The two adjacent cells Sb are disposed left-right symmetrically (including substantial left-right symmetry) on the front side and rear side in the rotation direction and configured by the outer teeth 21 and the inner teeth 31 constituting the central cell Sa and also by the outer teeth 21 and the inner teeth 31 positioned in front of the those outer teeth 21 and inner teeth 31 and behind thereof in the rotation direction (see FIGS. 1A and 1B).

The formation region of the tooth tip 21*a* of the outer tooth 21 is also in contact with the inner tooth 31 in both aforementioned adjacent cells Sb. This contact location is called contact point P2. In other words, the sealed state of the central cell S is configured by the contact points P1, and the sealed state of the adjacent cell Sb is configured by the contact point P1 and the contact point P2 (see FIG. 1B). By sealing the central cell S or the adjacent cell Sb, it is possible to transport the oil.

In the embodiment of the present invention, a total of three cells S, namely, the central cell Sa position above the maximum partition portion 13 and two adjacent cells Sb positioned in front of the central cell Sa and behind thereof in the rotation direction, are all sealed. The contact point P1 and the contact point P2 are contact locations of the region of the tooth tip 21*a* of the outer tooth 21 and the region of the tooth tip 31*a* of the inner tooth 31. The contact point P1 is closer than the contact point P2 to the tooth tip 21*a* and the tooth tip 31*a*.

Figure 2A:
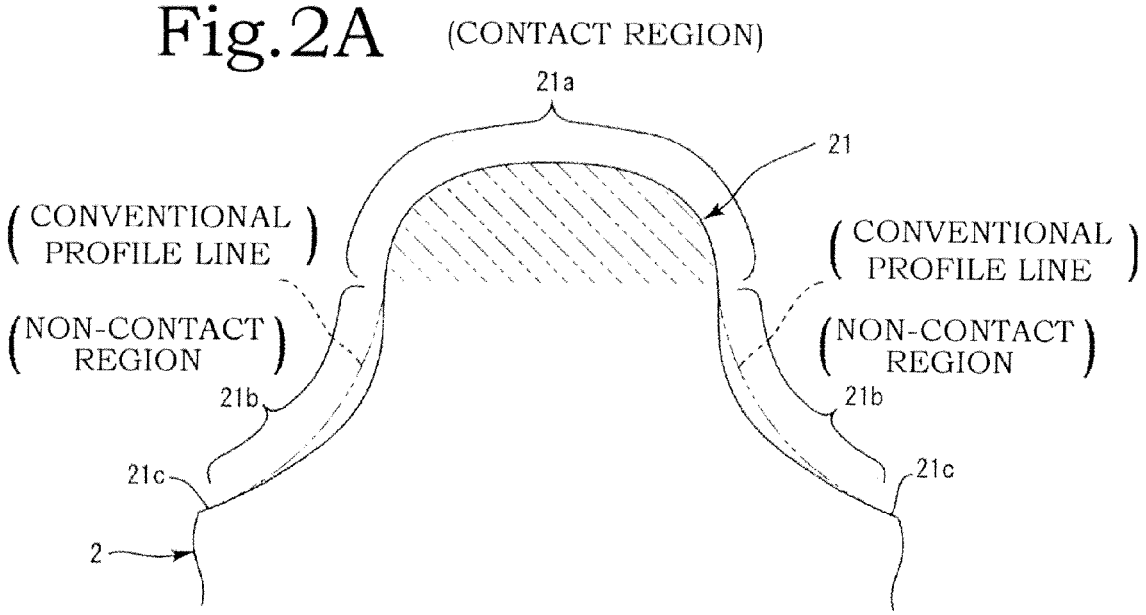
FIG. 2A is an enlarged front view of the outer tooth of the inner rotor.
Figure 2B:
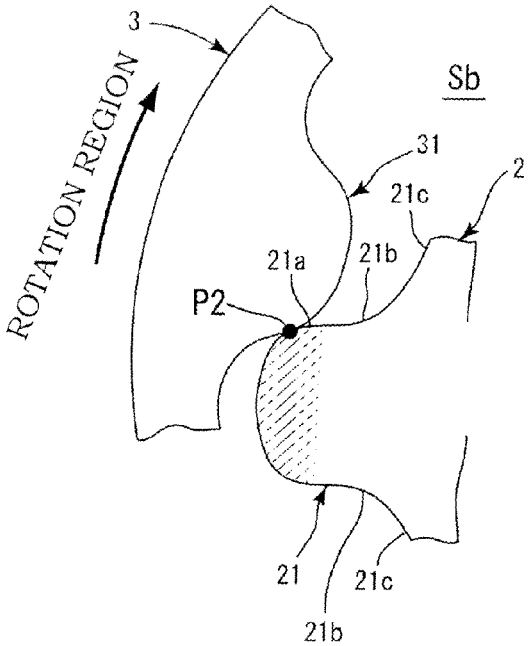
FIG. 2B is a principal enlarged view illustrating the state in which the contact region of the outer tooth tip is in contact with the inner tooth.

Therefore, the entire range of the tooth tip 21*a* of the outer tooth 21, or a range somewhat narrower than the entire range, becomes a contact region of contact with the inner tooth 31 of the outer rotor 3 (see FIGS. 2A and 2B). In the outer tooth 21, the contact point P1 and the contact point P2 of contact with the tooth tip 31*a* of the inner tooth 31 are constituted only by the contact region of the tooth tip 21*a*.

A plurality of cells S is formed in locations close to the minimum partition portion 14 side. The cells S configured at the front side and rear side, in the rotation direction, of the minimum partition portion 14 are configured such that the inner tooth 31 cuts in with a small spacing between the two outer teeth 21 have a small but non-zero volume, and have the configuration of the cell S (see FIG. 1A).

In FIG. 1A, the cells S on the minimum partition portion 14 side communicate with each other. This communication is due to the fact that the tooth tip 21*a* of the outer tooth 21 of the inner rotor 2 position closed to the minimum partition portion 14 and the tooth tip 31*a* of the inner tooth 31 of the outer rotor 3 are not brought close to a degree such that the cell S and the cell S can be sealed.

Figure 2C:
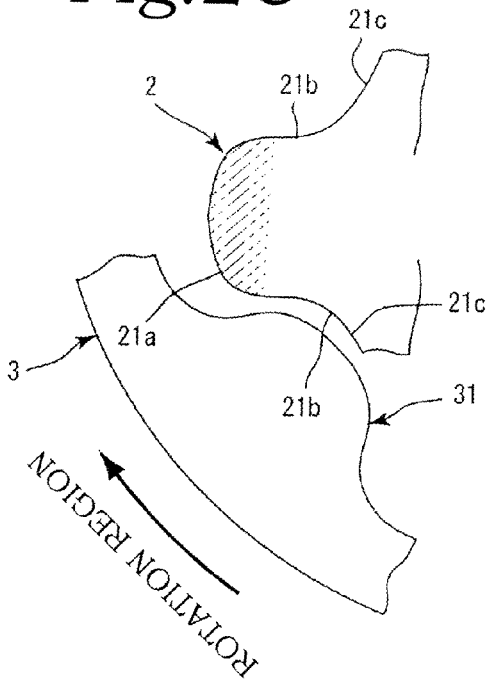
FIG. 2C is a principal enlarged view illustrating the state in which the contact region of the side surface of the outer tooth is in contact with the inner tooth.

The outer tooth 21 present at a position serving as a boundary of the sealed adjacent cell Sb located behind the central cell Sa in the rotation direction and the other cell S has the contact point P2 of contact with the inner tooth 31 on the front side in the rotation direction and has no point of contact with the inner tooth 31 on the rear side in the rotation direction. In order to obtain such a configuration, a side surface 21*b* that slightly recedes inward from the conventional outer tooth profile is formed between the tooth tip 21*a* and the tooth bottom 21*c* in the outer tooth 21. This side surface 21*b* is a non-contact region that does not come into contact with the inner tooth 31 of the outer rotor 3 (see FIGS. 2A and 2C). The non-contact region enables the communication of the cells S configured close to the minimum partition portion 14.

The number of sealed cells may be increased to five or seven correspondingly to the increase in the number of the outer teeth 21 of the inner rotor 2 and the inner teeth 31 of the outer rotor 3. Further, the number of communicating cells S, S can be easily increased from two as in the present embodiment to three and four.

The contact region and non-contact region can be also applied to the inner tooth 31 of the outer rotor 3. Thus, the tooth tip 31*a* of the inner tooth 31 can be a region of contact with the outer tooth 21 of the inner rotor 2. Further, a side surface 31*b* that slightly recedes inward from the conventional outer tooth profile can be formed between the tooth tip 31*a*, the tooth bottom 31*c* side, and the tooth tip 31*a* side. This side surface 31*b* is a non-contact region that does not come into contact with the outer tooth 21 of the inner rotor 2.

What is claimed is:

1. An oil pump comprising:

a pump body;

an inner rotor having outer teeth; and an outer rotor having inner teeth, wherein a maximum partition portion is formed between a trailing end side of an intake port and a leading end side of a discharge port in a rotor chamber of the pump body, a minimum partition portion is formed between a trailing end side of the discharge port and a leading end side of the intake port, in a cell constituted by the outer teeth of the inner rotor and the inner teeth of the outer rotor, an inner tooth of the outer rotor meshes so as to penetrate between the outer teeth of the inner rotor at the minimum partition portion, a total of three cells including a central cell positioned at a location of the maximum partition portion and two adjacent cells positioned in front of the central cell and behind the central cell in a rotation direction, are sealed by mutual contact of the outer teeth and the inner teeth, and on a minimum partition portion side, the outer teeth and the inner teeth are not brought close to a degree such that the outer teeth and the inner teeth can seal cells, and the cells communicate with each other.

2. The oil pump according to claim 1, wherein a tooth tip of the outer tooth of the inner rotor is a contact region that is in contact with the inner tooth of the outer rotor, and a side surface between the tooth tip and tooth bottom of the outer tooth is a non-contact region that is not in contact with the inner tooth.

3. The oil pump according to claim 1, wherein the inner rotor comprises a substantially gear shape and the outer rotor comprises a substantially annular shape.

4. The oil pump according to claim 1, wherein the inner rotor is formed inside of the outer rotor.

5. The oil pump according to claim 1, wherein a rotation center of the inner rotor is set apart from a rotation center of the outer rotor.

6. The oil pump according to claim 1, wherein a plurality of cells are formed between the inner teeth and the outer teeth, the plurality of cells including the central cell, the adjacent cell and the cells on the side of the minimum partition portion other than the adjacent cells.

7. The oil pump according to claim 1, wherein an outer tooth of the outer teeth comprises a non-toroidal profile that is formed as a curve of a second order or a higher order, and a profile of an inner tooth of the inner teeth comprises an envelope curve which is an outermost trajectory shape attained when the inner rotor rotates.

8. The oil pump according to claim 1, wherein the inner teeth are left-right symmetrical with respect to a vertical line passing through a rotation center of the outer rotor, and the outer teeth are left-right symmetrical with respect to a vertical line passing through a rotation center of the inner rotor.

9. An oil pump, comprising a pump body;

a rotor chamber formed in the pump body and comprising:

an input port;

a discharge port;

a maximum partition portion formed between a trailing end side of the intake port and a leading end side of the discharge port; and a minimum partition portion formed between a trailing end side of the discharge port and a leading end side of the intake port;

an inner rotor formed in the rotor chamber and including a plurality of outer teeth; and an outer rotor formed in the rotor chamber and including a plurality of inner teeth, an inner tooth of the plurality of inner teeth meshing with and penetrating between the plurality of outer teeth at the minimum partition portion, wherein a plurality of cells are formed between the plurality of outer teeth of the inner rotor and the plurality of inner teeth of the outer rotor, the plurality of cells comprising:

a central cell formed at the maximum partition portion;

two adjacent cells formed in front of the central cell and behind the central cell in a rotation direction, the two adjacent cells being sealed by contact between the plurality of outer teeth and the plurality of inner teeth; and other cells formed on a side of the minimum partition portion, the outer teeth and the inner teeth being separated such that a cell of the other cells on the side of the minimum partition portion communicates with another cell of the other cells on the side of the minimum partition portion.

* * * * *